United States Patent [19]

Smith

[11] 4,384,566

[45] May 24, 1983

[54] PREFABRICATED FIREPLACE

[76] Inventor: Rodney I. Smith, Midland, Va. 22728

[21] Appl. No.: 177,284

[22] Filed: Aug. 11, 1980

[51] Int. Cl.[3] ..... F24B 7/00; E04H 12/28

[52] U.S. Cl. ..... 126/121; 126/120; 126/132; 126/138; 126/143; 126/202; 52/79.9; 52/218; 52/219; 52/583

[58] Field of Search ..... 126/120, 121, 131, 132, 126/122, 99 R, 140, 143, 200, 202, 307 R; 52/218, 219, 79.9, 583; 98/58-60

[56] References Cited

U.S. PATENT DOCUMENTS

| | | | |
|---|---|---|---|
| 1,085,889 | 2/1914 | Carl | 98/58 |
| 1,756,511 | 4/1930 | Dowler | 126/132 |
| 2,398,240 | 4/1946 | Merryweather et al. | 126/140 |
| 2,969,787 | 1/1961 | Dupler | 126/200 |
| 3,466,000 | 9/1969 | Southern et al. | 126/120 |
| 3,733,757 | 5/1973 | Scott | 52/583 |
| 3,874,364 | 4/1975 | Fauser | 126/121 |
| 4,131,104 | 12/1978 | Choate | 126/60 |

OTHER PUBLICATIONS

Heatform Fireplaces Catalog 38M-1956 by the Superior Fireplace Co. pp. 26-27.

*Primary Examiner*—Samuel Scott
*Assistant Examiner*—Lee E. Barrett
*Attorney, Agent, or Firm*—Gipple & Hale

[57] ABSTRACT

A prefabricated fireplace comprises a firebox and flue enclosed by concrete cast as a unit. The firebox has inner walls defining a fuel box in which combustion occurs and outer walls which define a circulation space around the fuel box for room air to be heated. The fuel box is sealed from the room by glass doors which open to supply fuel and, when closed, allow light and heat to pass, and oxygen reaches the fire through an outdoor duct. The prefabricated fireplace has around its base edges a plurality of weldplates which allow quick installation by welding to metal base plates cast in the foundation. The prefabricated fireplace may also include means to interface with home forced-air and water heating systems for heating of air and water.

9 Claims, 8 Drawing Figures

Fig. 7
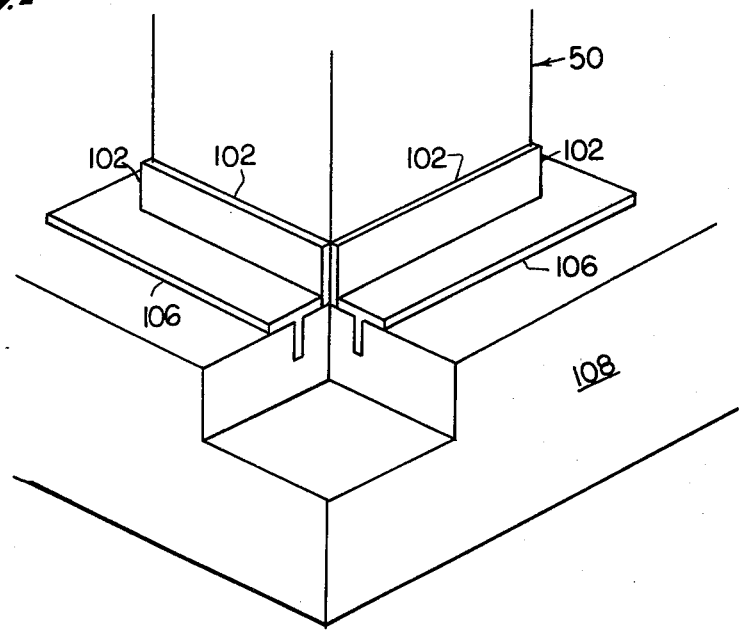
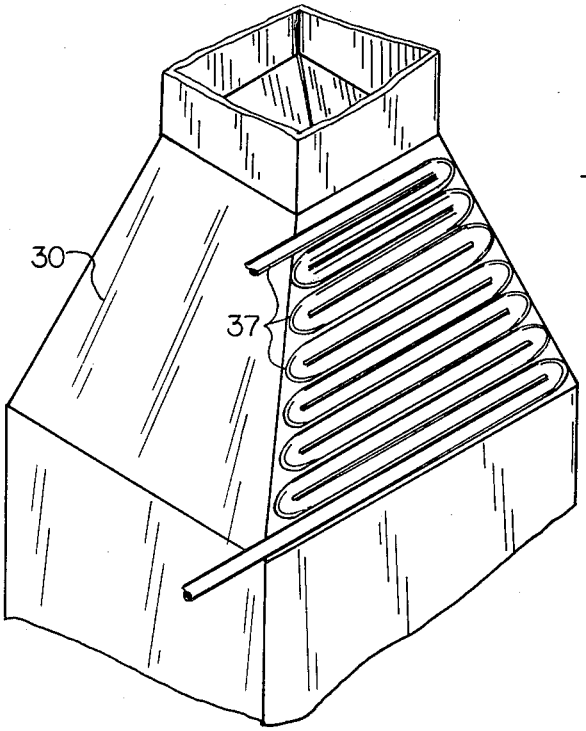
Fig. 8

PREFABRICATED FIREPLACE

BACKGROUND OF THE INVENTION

This invention relates in general to prefabricated residential housing components, and more particularly to a prefabricated fireplace having stovelike air circulation.

The demand for an energy efficient prefabricated fireplace has grown significantly during the past several years in response to the concurrent increases in fossil fuel costs and in residential construction labor costs. As home heating fuel prices have risen, the attractiveness of wood as an alternative fuel and of an efficient fireplace as a heat distributor has been widely recognized, especially since wood is a renewable resource of domestic origin. As the cost of skilled labor for masonry has risen, prefabricated efficient fireplaces have become a cost-effective means to meet the demand for wood-burning home heating systems.

By its nature, the process of residential construction includes certain hazards for custom custom-built masonry, so that a custom-built fireplace may be damaged or improperly assembled during its construction, forcing delays and additional material costs or resulting in poor performance. However, even prior prefabricated fireplaces have featured installation deficiencies which expose uncured concrete to construction hazards for several days. For instance, U.S. Pat. No. 3,466,000 discloses a prefabricated fireplace with a reinforcing frame, the longitudinal reinforcing members of which extend below the bottom of the ashbox to be mounted in an uncured concrete base. The prefabricated fireplace must remain in place with the longitudinal reinforcing members extending into the base while the base concrete cures without placing the weight of the fireplace, which is typically 8,000 to 13,000 pounds, on the base. Therefore, substantial support arrangements must be made for the fireplace, which arrangements may obstruct other construction activities during the cure process. The cure process normally takes seven days in warm weather, and a longer period as temperatures drop.

Furthermore, prior prefabricated fireplaces have provided only the traditional open firebox and flue, which features involve inherent disadvantages. A large fraction of the hot air produced by a wood fire in an open firebox escapes through the open chimney without reaching a house's occupants, and the fire draws cold outdoor air for combustion oxygen into the house through unsealed doors and windows. The interior of the house is warmed only by radiation of the fire and the fireplace masonry, and can be subject to irritating smoke and ash whenever outdoor winds blow these materials back down the flue.

United States Pat. No. 2,430,393 discloses air heater apparatus which includes a closed firebox and flue. The apparatus burns gas behind a sealed window, drawing new oxygen from a direct vent to the outside. The hot fire exhaust circulates through a heat exchanger baffle on its way to the flue, and there transfers some of its heat to room air which circulates through a separate duct network. Therefore, the room receives some exhaust heat as well as fire radiation without exposure to flue backwash or cold outdoor air drawn by the fire. However, this circulation system has heretofore been unadaptable to the use of wood fuel because the need to load wood by hand was incompatible with the need for a sealed window between the fire and the room.

SUMMARY OF THE INVENTION

According to the invention, a prefabricated fireplace comprises a firebox and flue enclosed by concrete cast as a unit. The firebox includes an inner fuel box where wooden logs or similar articles of fuel are burned, and an outer air circulation space, surrounding the inner fuel box, where room air is circulated to gain heat from the walls of the fuel box. Transparent doors are mounted to form one side of the fuel box where the fuel box extends to the surface of the cast concrete. The air tight doors open to provide access to the fuel box for addition of fuel from time to time and, when closed, prevent room air from entering the fuel box and smoke from entering the room while allowing the warmth and pleasing image of a fireplace fire to radiate into the room.

A plurality of room air vents set in the surface of the cast concrete allow room air to flow into and out of the outer air circulation space. Each vent may be covered with a louvered grill to prohibit accidental placement of unwanted articles in the vent. A small electric-powered circulation fan may be placed behind each grill to increase air circulation, in which case the the grill also provides structural support for the fan and prevents contact of rapidly-spinning fan blades with human fingers or other items which could be damaged thereby.

An exterior air vent communicates between the fuel box and the outdoors, in order to feed oxygen-rich air to burning fuel. An apex of the firebox is open to the flue, which allows hot smoke to rise and exit the fireplace. A flue cap is placed atop the flue to prevent animals, rain, leaves, and other unwanted outdoor material from entering the flue and plugging it or reaching the fire. The flue is lined with ceramic tiles or other materials which resist combustion or chemical reaction with the chemical components of wood smoke at high temperatures.

The surface of the firebox adjacent the cast concrete is lined with insulation of approximately one inch thickness, providing a non-combustible padding layer so that the firebox walls may flex and expand into the padding when heated. The exterior of the cast concrete may be shaped to fit the architectural constraints of each house and may be textured to complement interior and exterior decor as well.

The bottom edges of the prefabricated fireplace has a number of metal angles cast in the concrete suitable for welding. A flat foundation of concrete is poured at the installation site, and flat strips of metal are secured to the flat horizontal surface of the foundation so as to surround the correct placement of the fireplace base. The bottom edge of the fireplace is then aligned with the base so that the metal band around the fireplace may be bead welded to the base strips.

The objects and advantages of the present invention are to be more fully revealed by the following discussion of the accompanying drawings in which:

BRIEF DESCRIPTION OF THE DRAWINGS

FIG. 7 is a perspective view in partial cutaway of the bottom of the fireplace showing the installation system; and FIG. 8 is a perspective view in partial cutaway of the rear of the fireplace, showing the water circulation system.

DETAILED DESCRIPTION OF THE DRAWINGS

Figure 1:
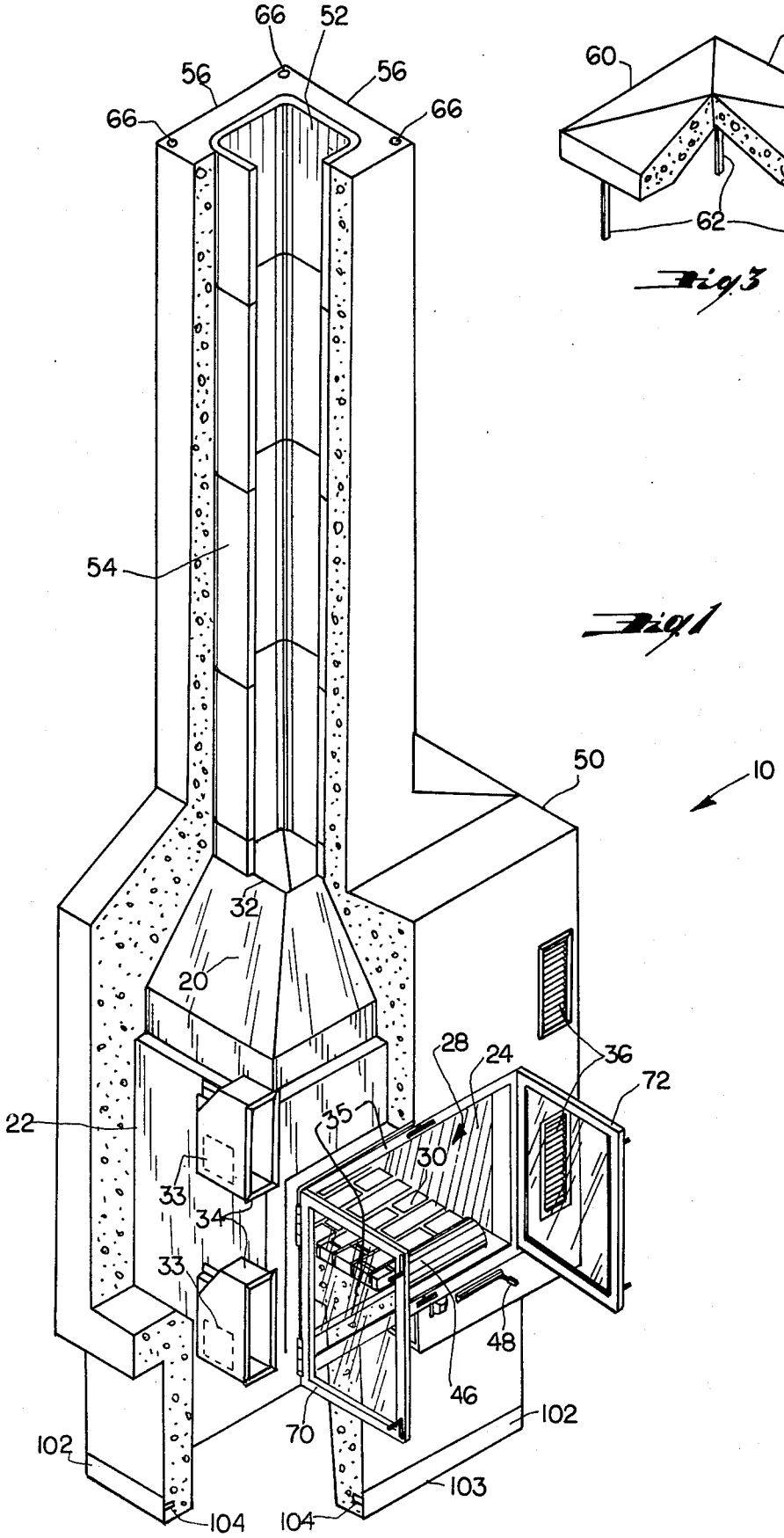
FIG. 1 is a front elevated perspective view of the precast fireplace of the invention, partially in cutaway.
Figure 2:
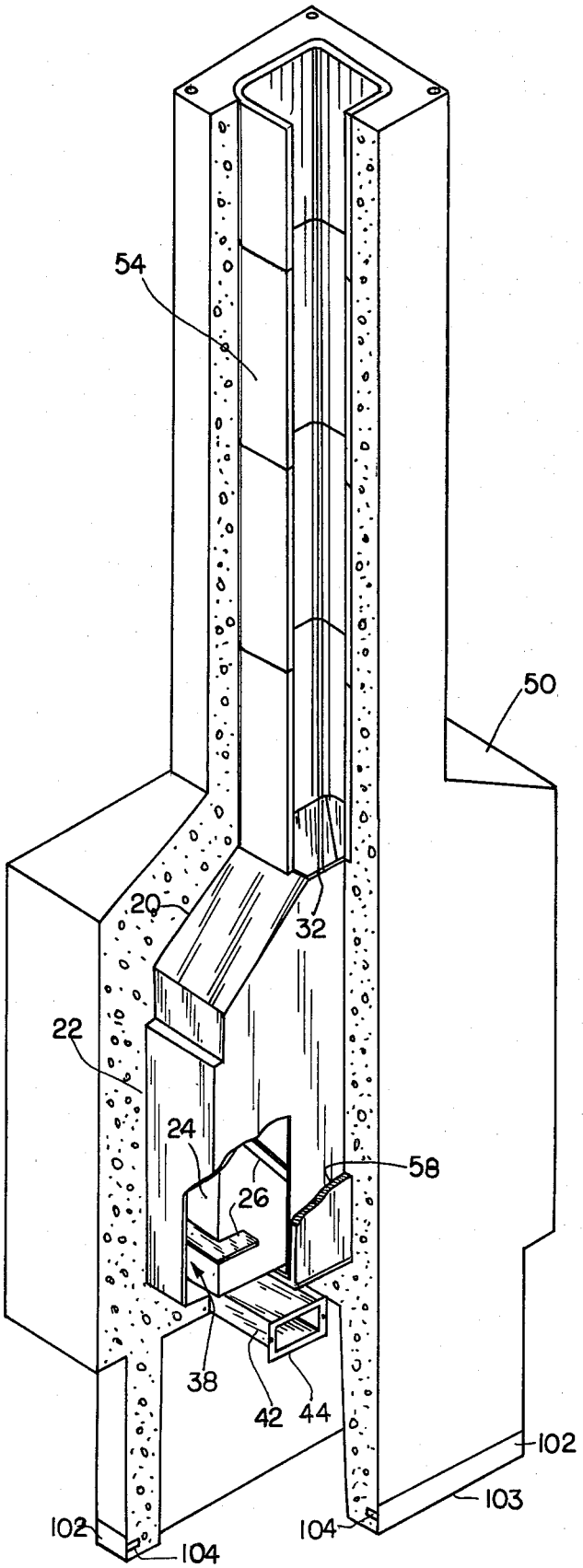
FIG. 2 is a rear elevated perspective view of the fireplace of FIG. 1, partially in cutaway.

The prefabricated fireplace of the invention is most clearly shown in FIGS. 1 and 2, which illustrate the best mode of the invention.

A prefabricated fireplace, generally indicated at 10, comprises a firebox 20 enclosed by a precast concrete shape 50, and the concrete shape 50 also defines a vertical flue 52 between the top of the firebox 20 and the top of the concrete form 50. The firebox comprises an outer wall 22 and an inner wall 24, best seen in FIG. 2, and the two walls are separated by struts 26 placed therebetween. Turning to FIG. 1, the space defined within inner wall 24 is a flue box 28, in which wooden logs or other items of fuel may be burned. The bottom of the fuel box 28 is lined with fire-resistant bricks 30 to form a base for combustion. The top of the fuel box 28 defines an aperture 32 through which smoke may pass from a fire to the flue and thereafter to the outdoors.

The front face of the fuel box 28 defines a large aperture 35 through which the fireplace user may replenish fuel from time to time. Otherwise, during a fire the aperture 35 is sealed by fire doors 70 and 72, shown in FIG. 1 in an open position. When the doors 70 and 72 are closed, the fire draws oxygen-rich air from the outdoors through exit vent 46, which is connected to outdoor duct 42 (shown in FIG. 2) opening to the outdoors on the reverse face of the fireplace. A conventional louvered grill, not shown, may cover the outdoors opening 44 of the duct 42 to prevent entrance of unwanted objects.

Air is drawn from outdoors through the duct 42 to the fire by the pressure difference resulting from smoke expanding and rising from the fire. Air enters the fuel box 28 from the exit vent 46. Any conventional airflow limitation device may be placed within duct 42 to control the influx of oxygen and therefore, the rate of combustion in the fuel box. Such an airflow limitation device may have control means 48 mounted on the front face of the concrete form 50.

The space enclosed between inner wall 24 and outer wall 22 is a circulation space 38 through which indoor air circulates to receive heat from inner wall 24 when fuel is burned in the fuel box 28. Ducts 34 placed on both sides of firebox 20 provide for passage of air to and from the circulation space 38. Two such indoor ducts 34 are revealed in the cutaway portion of FIG. 1, and two more are covered by conventional louvered grills 36. A conventional miniature electric fan, not shown, may be mounted behind the grill 36 and within each indoor duct 34 to augment the natural convection currents of indoor air through the ducts 34 and the circulation space 38.

Knockout plates 33, shown in phantom in FIG. 1, may optionally be placed on the outside vertical faces of ducts 34. Removal of the knockout plates 33, and of corresponding adjacent portions of concrete shape 50, will allow forced-air ducts of a conventional home air heating plant to be coupled through the holes left by knockout plates 33 to the circulation space 38. Coupling of the home air heating plant and the circulation space will reduce the demands on the home heating plant by adding thereto the heating capability of the present invention. The user may then wish to seal the indoor ducts 34 by replacing grills 36 with sealing plates of appropriate size.

The demands on a conventional water heater plant may likewise be reduced by circulating the water from a water heater through pipes within the circulation space 38 or concrete shape 50 on its way to home water taps and spigots. FIG. 8 shows one placement of water pipes 37 within circulation space 38.

Figure 3:
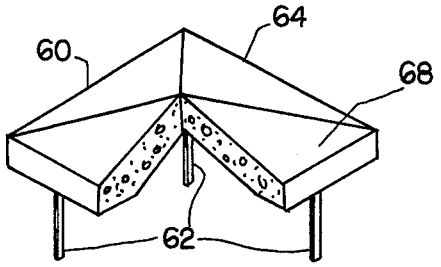
FIG. 3 is an elevated perspective view of a flue cap adapted to be removably secured atop the flue of the fireplace.

The flue 52 may be lined with heat resistant tiles 54 to prevent damage to the interior of concrete shape 50 by heat and active combustion by-products, the latter of which are known to be deposited in a flue as smoke rises from a fireplace. The flue may be capped by the removable prefabricated cap structure 60 shown in FIG. 3. The cap structure 60 includes support legs 62 extending vertically beneath sloping cap 64. The support legs 62 are spaced apart so as to match the spacing of blind bores 66 defined in the uppermost end of the concrete shape 50 surrounding the flue 52, and the diameter of each leg 62 equals that of each bore 66. The cap 64 includes one or more slanted upper surfaces 68 to allow precipitation to slide off, and the edges of cap 64 are longer than the edges 56 of the concrete shape 50 so that the cap structure 60 overhangs the edges 56. Thus, precipitation sliding from the cap 64 will not fall into the flue 52. The blind bores 66 are shorter than the legs 62 so that smoke exiting the flue will find space to pass horizontally between the bottom of cap 64 and the edges 56 of concrete shape 50.

Outer wall 22 of firebox 20 is typically made of metal. Transfer of heat from inner wall 24 to outer wall 22 during a fire will normally cause outer wall 22 to expand and flex. If the outer wall 22 were in direct contact with concrete shape 50, the outer wall would be forced by the rigidity of concrete to flex inwardly through circulation space 38 toward inner wall 24 or to fracture the concrete shape 50. In order to minimize risk of expanding walls blocking circulation space 38 or fracturing concrete shape 50, the outside firebox 20 is lined with conventional heat insulating material 58 approximately one inch in thickness. The outer wall 22 will flex into and compress the insulating material 58 which will not be harmed by the compression or the high surface temperature of outer wall 22.

Figure 4:
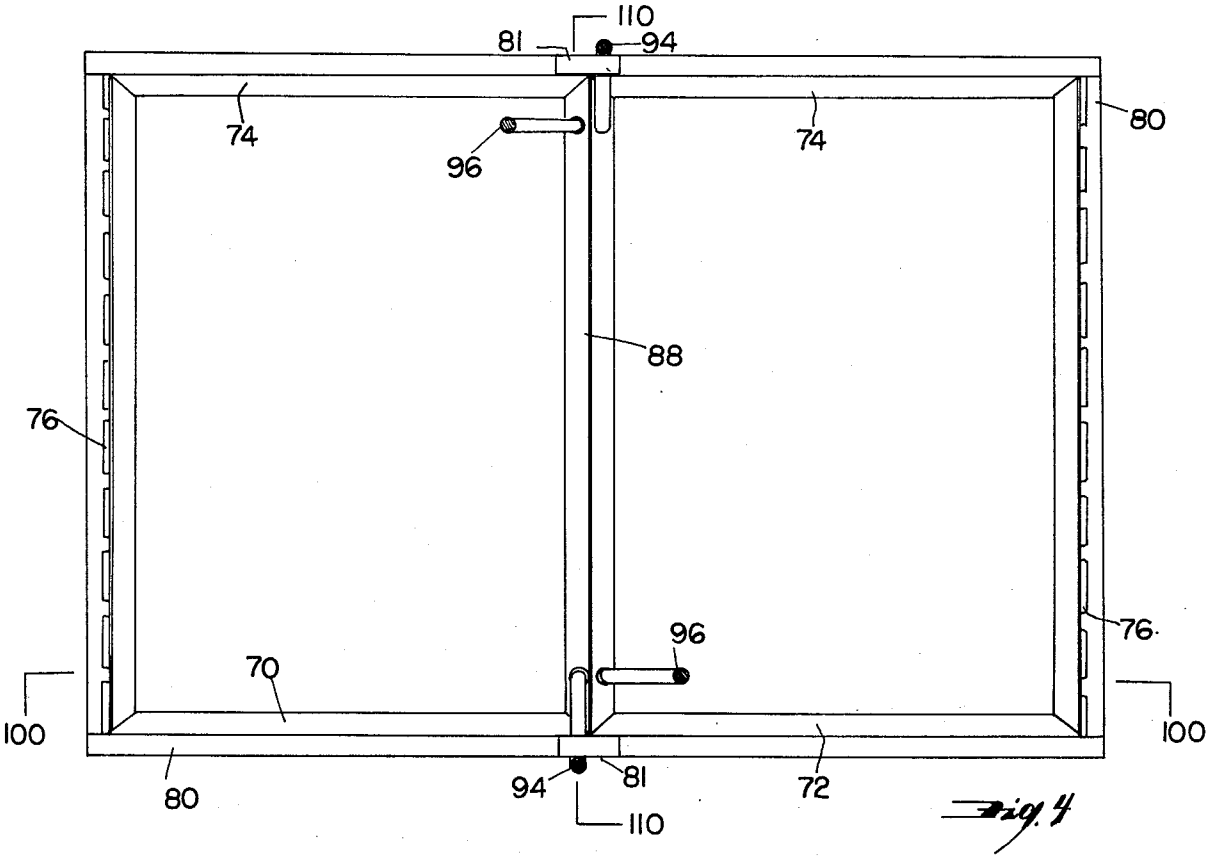
FIG. 4 is a front view of the fuel box doors shown in closed position.
Figure 6:
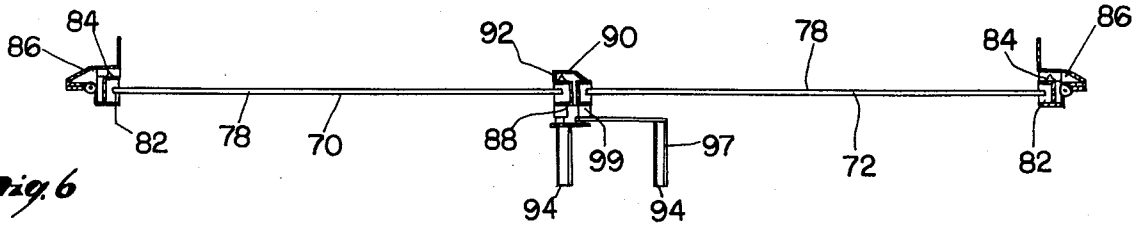
FIG. 6 is a cross sectional view taken at line 100—100 of the doors of FIG. 4.
Figure 5:
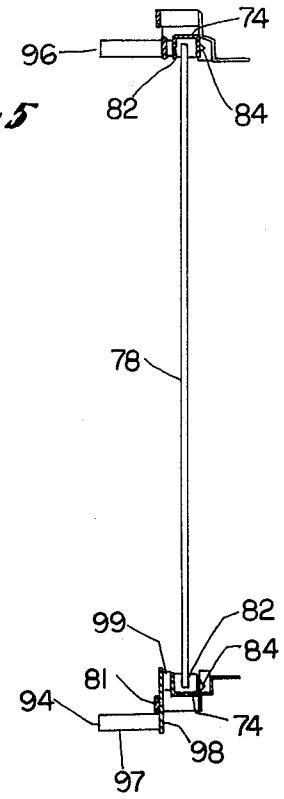
FIG. 5 is a cross-sectional view taken at line 110—110 of the doors of FIG. 4.

Turning now to FIGS. 4, 5, and 6, each of the doors 70 and 72 comprise glass frame 74, hinge 76 and glass pane 78. The doors are surrounded by outer frame 80, to which hinges 76 are attached so that the doors 70 and 72 may swing to and fro outer frame 80. The outer frame 80 is fixed to aperture 35 of fuel box 28. The outer frame 80 also extends behind glass frames 74 so that gaskets 82 and compression ribs 84 attached to the frames 74 may press against gaskets 86 attached to the front of outer frame 80, thereby providing an airtight seal around the aperture 35 when the doors 70 and 72 are closed.

Each glass pane 78 is edge mounted in gaskets 82 on all edges of glass panes 78, including the edges 88 where the doors 70 and 72 meet when closed. To assure an airtight seal between edges 88, overlap gasket 90 is mounted to edge 88 of door 72 and compression rib 92 is mounted to edge 88 of door 70 so that rib 92 contacts and compressed gasket 90 when door 72 is closed before door 70.

Each of doors 70 and 72 has rotatable handles 94 and 96 mounted to door frame 74 adjacent edge 88. The handles 94 and 96 comprise handgrip 97 and crank 98, and will rotate in a plane parallel to the surface of glass pane 78 about pivot point 99 in response to force applied by hand to handgrip 97. Clips 81 are mounted to outer frame 80 within the rotation arcs of handles 94 and 96 so that doors 70 and 72 may be locked when closed by rotating handles 94 and 96 to lodge cranks 98 in clips 81. Handles 94 are shown in the locked position, and handles 96 are shown in the unlocked position.

Since the doors 70 and 72 are necessarily close to the fire in fuel box 28, all materials used in the doors should be heat-resistant and flame-resistant. An an example (not meant to limit the scope of the invention) in a working embodiment of the invention, all gaskets were carborundum ¼ inch thickness Fiberfrax and the glass panes were Corning Pyroceram. The hinges 76 were a continuous piano type, and the inner frames 74 were any appropriate 22 gauge metal.

While the precast concrete form 50 has been shown with substantially smooth exterior surfaces, conventional casting techniques may provide texturing of the exterior surfaces to complement the architectural design and interior decorating scheme of the dwelling for which the fireplace is intended.

The bottom edge of the precast concrete shape 50 is surrounded by a weldplate 102, and the bottom edge of 103 of weldplate 102 is flush with the bottom edge of the precast concrete form 50. As shown in FIGS. 1 and 2, the weldplate may be of a T-shaped configuration with the vertical portion 104 of the T embedded in the precast concrete form 50 at the time of casting. The weldplate 102 may, however, be configured as angle iron or in other ways allowing a portion to be embedded, or the weldplate 102 may be a flat plate secured to precast concrete form 50 by bolts or in any other conventional manner producing a strong connection.

As shown in FIG. 7, the prefabricated fireplace 10 is installed by placing precast concrete shape 50 atop metallic base strips 106, secured to concrete base 108. The base strips 106 are illustrated with a T cross-sectional configuration with the vertical portion of the T embedded in base 106 but, as discussed above with regard to the weldplates 102, the base strips 106 may be of other cross-sectional configurations amenable to being embedded, or may be flat and secured to base 108 in other ways. The base strips 106 are placed on base 108 so that the bottom edge 103 of weldplate 102 sits next to base strips 106. A bead weld may then be formed around the circumference of precast concrete form 50 between base strips 106 and weldplate 102, thereby securing the precast concrete fireplace 50 to base 108. It is, of course, necessary to align base strips 106 carefully in order to conform with proper architectural placement of prefabricated fireplace 10 against a dwelling. However, base 108 may be poured and base strips 106 secured without affecting or being affected by other construction activities in the immediate area, and without the necessity of installing prefabricated fireplace 10 while the base 108 is uncured. Therefore, base 108 may be poured and base strips 106 may be secured at any time prior to arrival of prefabricated fireplace 10 on the construction site, thus adding flexibility to this aspect of the construction schedule.

It will be apparent to a person skilled in the art that the weldplate 102 need not completely surround precast concrete shape 50 in order for the prefabricated fireplace 10 to be fixed in place. Nonetheless, maximum stability is provided by a circumferential weldplate 102 and its associated bead weld to base stripe 106.

In operation, the doors 70 and 72 of prefabricated fireplace 10 are first opened by rotating the handles 94 and 96 away from clips 81 and then pulling the doors 70 and 72 to an open position. Since the gasket 90 of door 72 lies behind edge 88 of door 70, door 70 must be opened before door 72. When the doors are open, the user places fuel in the fuelbox 28 and ignites a fire therein. The doors 70 and 72 are then closed, door 72 being closed first in order to place gasket 90 behind edge 88 of door 70. The handles 94 and 96 are then rotated to lock behind clips 81.

Oxygen reaches the fire in the fuel box 28 from outdoors through outdoor opening 44, outdoor duct 42, and exit vent 46 in the fuelbox 28. The rate of combustion may be adjusted by manipulating the control means 48 of a conventional airflow limitation device, which controls the amount of air entering the fuelbox 28 from exit 46.

Meanwhile, smoke from the fire rises through aperture 32 and flue 52 to escape to the outdoors beneath cap structure 60. The cap structure 60 prevents entrance of precipitation into the flue from outdoors. In addition, a conventional flue damper (not shown) may also be provided.

In a short interval after the fire is ignited, the inner wall around fuelbox 28 becomes heated and will begin to transfer heat to circulation space 38 and outer wall 22. Convection currents then urge hot air to exit through ducts 34 at the top of circulation space 38, and cold air enters through ducts 34 at the bottom of circulation space 38 to be heated. These convection currents may be supplemented by conventional electric fans placed behind louvered grills 36 mounted on the surface openings of ducts 34. Alternatively, a conventional forced-air home heating system may be coupled to the circulation space 38 through knockouts 33 in ducts 34, and a circulation fan of the home heating system may supplement the convection currents.

As the inner wall 24 rises in temperature it may flex and expand. Struts 26 between inner wall 24 and outer wall 22 direct the flow of air in the circulation space 38 so that air drawn from the room contacts the entire surface of inner wall 24, to maximize heat transfer to the air and minimize inner wall expansion and hot spots. Outer wall 22 also flexes and expands when heated, thus compressing insulation 58 between the outer wall 22 and prefabricated concrete form 50, thus preventing pressure and heat from being applied directly to the inside of concrete shape 50 in a potentially damaging manner.

The user experiences not only the hot air from the circulation space 38 via ducts 34 or the home air heating system, but also the radiant heat emerging from fuelbox 28 through glass panes 78 of doors 70 and 72, as well as the visual pleasure of a fire in a fireplace as seen through the glass panes 78. The fire may be extinguished by adjusting control means 48 to shut off the flow of outdoor air to fuelbox 28.

It should be apparent that while there has been described what is now considered to be a presently preferred form of the invention, various changes may be made in the prefabricated fireplace without departing from the true spirit and scope of the present invention as set forth in the following claims.

What is claimed:

1. A prefabricated concrete fireplace comprising a precast concrete form, a preformed metal firebox embedded within said precast concrete form, said firebox having inner walls defining a fuel box and outer walls, a circulation space defined by said inner walls and said outer walls of said firebox; said fuel box having a top and a front aperture, said front aperture being coplanar with a vertical surface of said precast concrete form facing a room to be heated, said circulation space having at least a pair of indoor ducts, each of said indoor ducts allowing air to pass between said circulation space and said room to be heated; first and second glass doors, said glass doors being adapted to close upon said front aperture and provide an airtight seal around said aperture and between said doors; an outdoor duct, said outdoor duct providing outdoor air to said fuel box to support combustion in said fuel box when said doors are closed; a flue means defined within said precast concrete form and having upper and lower ends, said flue means being connected at its lower end to the top of said fuel box, said flue means being open to the outdoors at its upper end to allow escape of combustion smoke from said fuel box; compressible insulation means surrounding said outer walls, said compressible insulation means allowing said outer walls to expand and flex when heated without contacting said precast concrete form; and weldplate means secured to the outside of said precast concrete form, said weldplate being adapted to be welded to a plurality of base strips secured to a fireplace base, so that said prefabricated fireplace may be fixed to said fireplace base; each of said glass doors comprising a rectangular pane of high-temperature glass, the edges of each said pane of glass being surrounded by a first high-temperature gasket mounted in an inner frame; and an outer frame attached to the edges of said front aperture, a second high-temperature gasket attached to said outer frame facing said glass doors, and compression ribbing on said inner frames oriented to contact said second gasket, so that said inner frames will contact and compress said second high-temperature gasket to provide an air tight seal when said glass doors are closed.

2. The apparatus of claim 1, including an airflow control means to control the amount of outdoor air entering said fuelbox through said outdoor duct.

3. The apparatus of claim 1, wherein said indoor ducts are adapted for connection to a home air heating plant.

4. The apparatus of claim 1, including a powered circulation fan mounted within at least one of said indoor ducts.

5. The apparatus of claim 1, including an overhanging cap structure, said overhanging cap structure being removably mounted atop said flue means so as to allow combustion smoke to exit said flue means while preventing precipitation from entering said flue means.

6. The apparatus of claim 1, including a flue liner secured to said precast concrete form within said flue means, said flue liner comprising heat resistant tiles.

7. The apparatus of claim 1, including water piping adjacent the outside of said inner wall, said water piping being adapted for connection to a home water heating plant.

8. The apparatus of claim 1 wherein said first glass door further comprises an overlapping high-temperature gasket mounted to said first glass door along the edge of said inner frame of said first glass door adjacent said second glass door, said overlapping gasket extending from said inner frame to overlap the seam between said glass doors when said glass doors are closed; and wherein said second glass door further comprises compression ribbing on the inner frame of said second door adjacent said seam between said glass doors, said ribbing being oriented to compress said overlapping gasket when said glass doors are closed, thereby sealing said seam.

9. The apparatus of claim 1 wherein said glass doors include rotatable handles attached to said inner frames adjacent said outer frames; and wherein said outer frame includes locking clip means adjacent said rotatable handles adapted to removably retain said rotatable handles when said doors are closed against said first aperture, so that said doors may be locked against inadvertent opening.

* * * * *